United States Patent [19]

Dabney

[11] Patent Number: 4,779,292

[45] Date of Patent: Oct. 25, 1988

[54] BOX SPRING CROSS RAIL INCORPORATING EXTRUDED THRUST BEARING

[75] Inventor: Upton R. Dabney, Georgetown, Ky.

[73] Assignee: Hoover Group, Inc., Roswell, Ga.

[21] Appl. No.: 72,964

[22] Filed: Jul. 14, 1987

[51] Int. Cl.[4] ..... A47C 23/02; F16F 3/04

[52] U.S. Cl. ..... 5/247; 5/264 R; 267/100

[58] Field of Search ..... 5/254, 255, 247, 245, 5/263, 264 R, 264 B; 267/100, 107

[56] References Cited

U.S. PATENT DOCUMENTS

| | | | |
|---|---|---|---|
| 3,680,157 | 8/1972 | Slominski et al. | 5/247 |
| 3,755,833 | 9/1973 | Slominski | 5/247 |
| 3,971,081 | 7/1976 | Roe | 5/246 |
| 4,095,298 | 6/1978 | Pringle | 5/263 |
| 4,218,790 | 8/1980 | Mizelle | 5/247 |
| 4,253,208 | 3/1981 | Hancock et al. | 5/247 |
| 4,452,438 | 6/1984 | Hancock et al. | 5/247 X |
| 4,470,584 | 9/1984 | Mizelle | 5/247 X |
| 4,675,927 | 6/1987 | Mizelle | 5/247 |

FOREIGN PATENT DOCUMENTS

| | | | |
|---|---|---|---|
| 557304 | 5/1958 | Canada | 5/263 |

*Primary Examiner*—Michael F. Trettel

*Attorney, Agent, or Firm*—Harness, Dickey & Pierce

[57] ABSTRACT

A box spring assembly which includes a frame having cross rails, a mattress supporting platform located above the frame and a plurality of spring members mounted on the cross rails in a supporting relation with the platform. Each of the rails has at least a portion of a generally inverted U-shape with a pair of spaced upright webs of predetermined thickness, the webs having pairs of aligned slots each of which has an elongated central section of predetermined width in a vertical direction and end bearing sections of substantially C-shape and reduced width relative to the predetermined width. The bearing sections are of increased thickness relative to the predetermined thickness of the webs, at least some of the springs having mounting foot portions shaped to extend through an aligned pair of slots in the rails so that they rotatably engage the bearing sections at opposite ends of the slots. The result is a box spring assembly in which the springs are easier to assemble with the cross rails and the cross rails provide improved bearing surfaces for the mounting feet on the springs.

4 Claims, 3 Drawing Sheets

BOX SPRING CROSS RAIL INCORPORATING EXTRUDED THRUST BEARING

BACKGROUND OF THE INVENTION

This invention relates generally to formed wire box spring assemblies and more particularly to formed wire box spring assemblies which utilize shaped metal cross rails which locate and support the formed wire springs in the assembly.

U.S. Pat. No. 3,680,157 dated Aug. 1, 1972 and assigned to the assignee of this application discloses a box spring assembly of the type to which this invention relates. In the box spring assembly shown in U.S. Pat. No. 3,680,157, the formed wire springs are supported in aligned slots formed in the upright webs of the frame cross rails. Such slots are conventionally formed in a punch press wherein the punch is of a smaller size than the die for clearance purposes. This results in a slot edge surface having a burnished land area and a larger rough and pock marked fracture area. Only the land area can function effectively as a bearing surface for the spring torsion bars.

The present invention is an improvement over the box spring assembly shown in U.S. Pat. No. 3,680,157 in that it enables easier assembly of the formed wire springs and the metal cross rails and provides improved bearing surfaces in the cross rails for the torsion bars in the springs that engage the cross rails. In the cross rails of this invention, metal from the webs is extruded to form bearing sections at the ends of the punched slots which are smooth surfaces of increased thickness relative to the web thickness, in contrast to the punched slot construction wherein the bearing area that is achievable is substantially less than the web thickness.

SUMMARY OF THE INVENTION

The box spring assembly of this invention includes the usual rectangular supporting frame having cross rails and a plurality of load carrying spring members mounted on the cross rails. In the present invention, each of the rails has at least a portion of generally inverted U-shape with a pair of spaced upright webs of predetermined thickness. Pairs of aligned slots are formed in the webs and, in the improved box spring assembly of this invention, each of the slots has an elongated central section of predetermined width in a vertical direction and end bearing sections of substantially C-shape and reduced width relative to the width of the central section. The bearing sections are of increased thickness relative to the web thickness and at least some of the springs have foot portions shaped to extend through the aligned slots in the rails so that they rotatably engage the bearing sections at opposite ends of the slots.

The "keyhole" type of slot configuration in the present invention provides a larger center portion in each slot for initial spring entry thereby making it easier to mount the springs on the cross rails. In addition, the extruded ends of the slots provide improved thrust bearing surfaces for the torsion bars in the springs which engage the cross rails. The bearing surface constitutes an improved spring support in that it provides a smooth surface which is of increased contact area.

It can thus be seen that the cross rails of this invention enable the construction of formed wire box spring assemblies which are improved from the standpoint of durability and assembly with less chance for objectionable noise resulting from movement of the supporting springs on the cross rails.

Further objects, features, and advantages of this invention will become apparent from a consideration of the following description and the appended claims, when taken in connection with the accompanying drawing in which:

Figure 1:
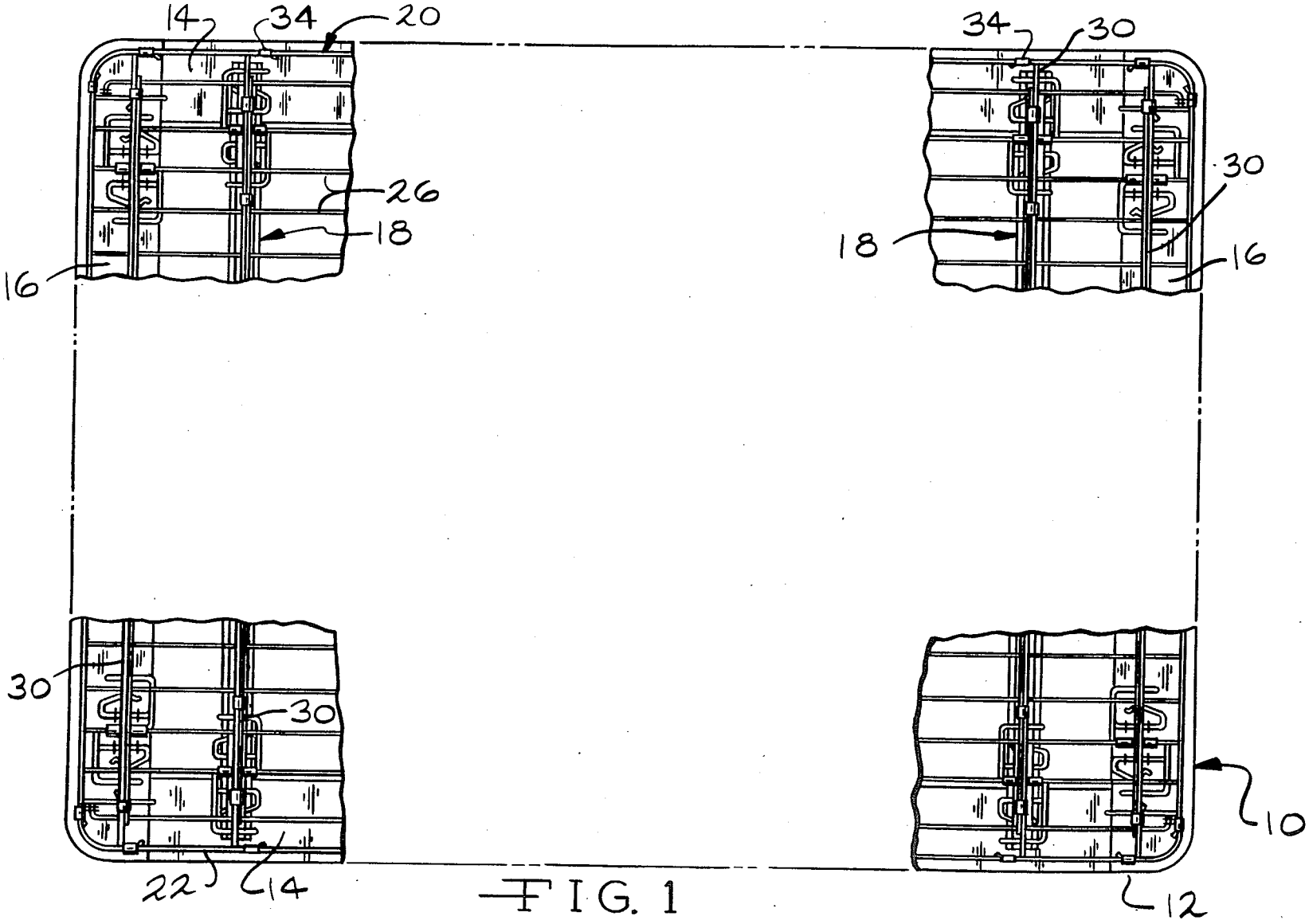
FIG. 1 is a foreshortened plan view of the box spring assembly of this invention.
Figure 2:
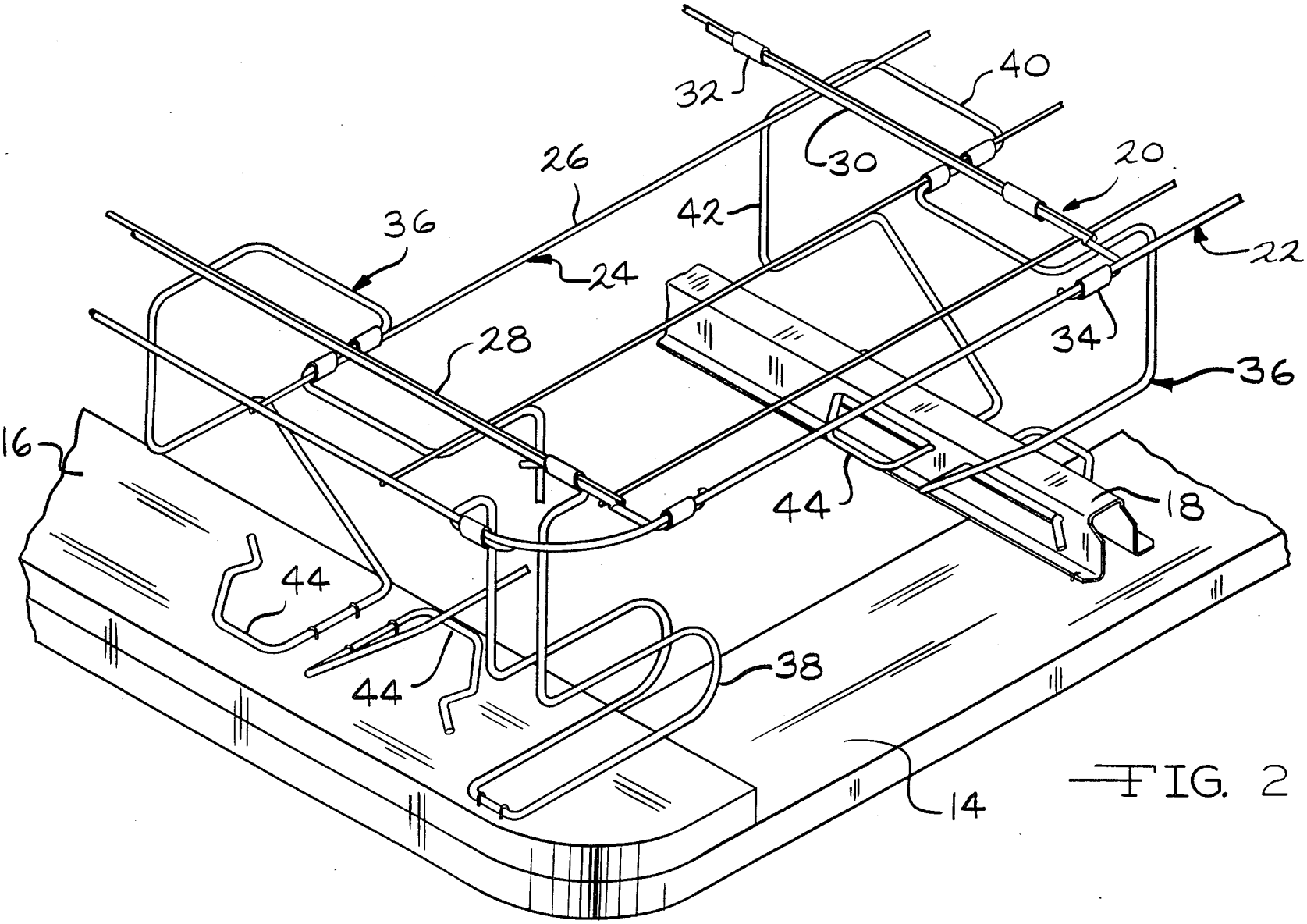
FIG. 2 is an enlarged fragmentary perspective view of a corner portion of the box spring assembly of this invention illustrating the improved cross rail construction.

With reference to the drawing, the box spring assembly of this invention indicated generally at 10, is illustrated at FIG. 1 as including a frame 12 having side rails 14, end rails 16, and a plurality of spaced cross rails 18 arranged at transversely spaced positions between the end rails 16. The box spring assembly 10 also includes a mattress supporting platform or deck 20 consisting of a border wire 22 and a grid 24 consisting of lengthwise wires 26 and cross wires 28. Supplementary cross wires 30 are secured by clips 32 to the cross wires 28 and by clips 34 to the border wire 22. As shown in FIG. 2, a supplementary cross wire 30 is located above and in substantial vertical alignment with each of the cross rails 18 and each of the end rails 16.

A plurality of spring modules 36 yieldably support the platform 20 on the cross rails 18. Additional spring modules 36 and corner springs 38 support the platform 20 on the end rails 16.

Figure 6:
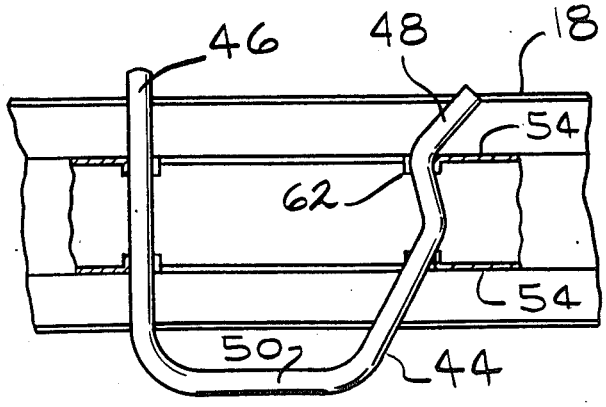
FIG. 6 is a horizontal sectional view of a cross rail with a spring assembled therewith.

The spring modules 36 are disclosed in U.S. Pat. No. 4,470,584, each module consisting of an upper connecting portion 40, upright yieldable column portions 42, and mounting foot portions 44. Each of the foot portions 44 includes a pair of torsion bars 46 and 48 (FIG. 6) which extend generally transversely of the cross rail 18 and are connected by a connecting portion 50. The torsion bar portions 46 and 48 are relatively arranged so that they are in a generally converging relation in a direction extending toward the connecting section 50.

Figure 3:
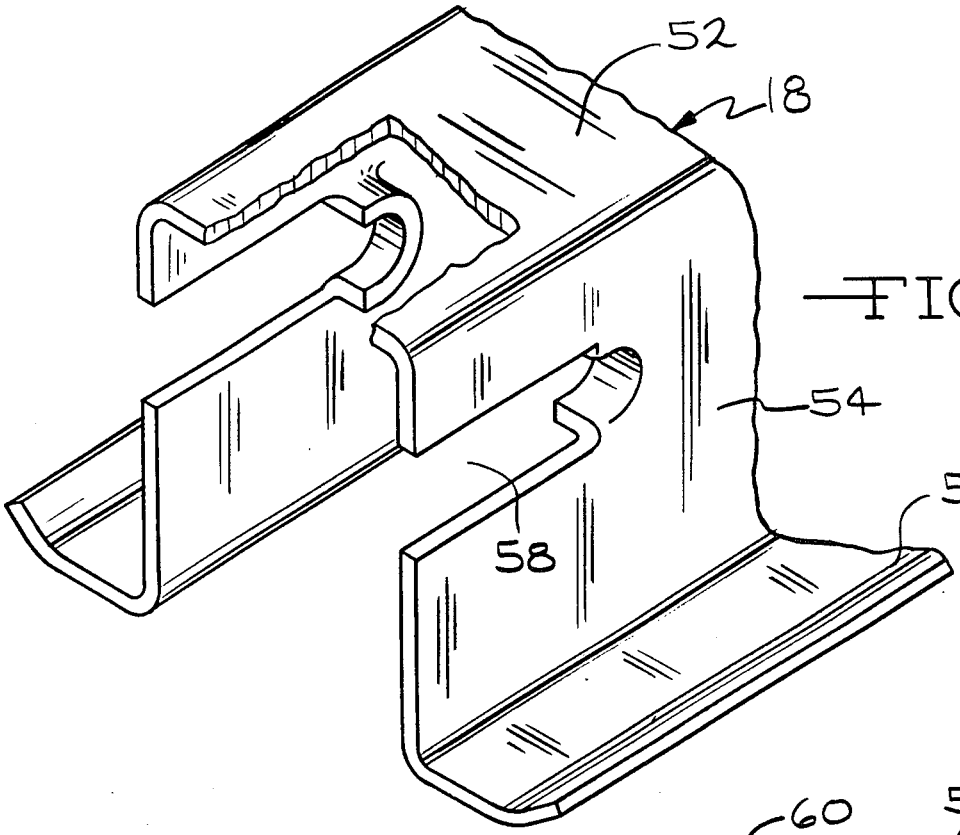
FIG. 3 is a fragmentary perspective view of a portion of a cross rail.
Figure 4:
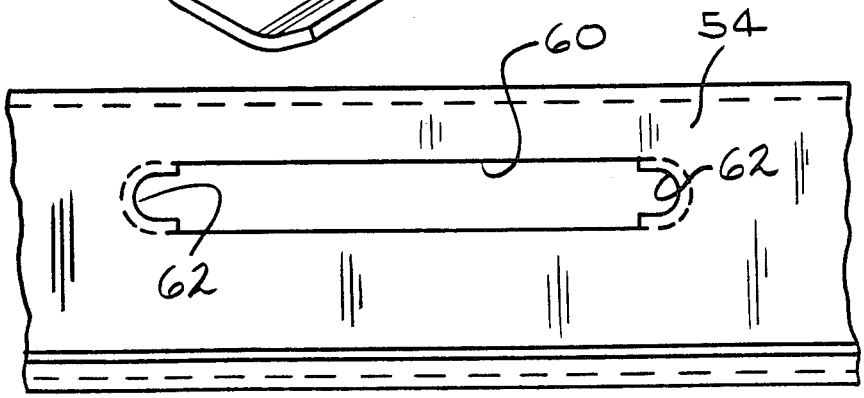
FIG. 4 is a fragmentary side view of a portion of a cross rail.
Figure 5:
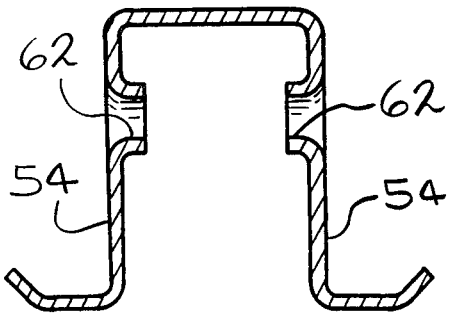
FIG. 5 is a transverse sectional view of the cross rail.

Each of the cross rails 18 is of generally inverted U-shape having a top portion 52 and depending generally upright webs 54 which extend downwardly therefrom and terminate in outwardly extending flanges 56. Pairs of horizontally aligned slots 58 are formed in the webs 54, each of the slots 58 having a horizontally elongated central section 60 (FIG. 4) of a relatively wide width in a vertical direction. Each of the slots 58 also has end bearing sections 62 of substantially C-shape and of reduced width in the vertical direction relative to the width of the central section 60. The bearing sections 62 are, as shown in FIG. 3, of increased thickness relative to the thickness of the webs. In fact, the end sections 62 are at least twice as thick as the web 54 in which they are formed. The end sections 62 are formed by extruding metal from the webs 54 into the sections 62 so as to form them of the desired width.

When the mounting foot portion of a spring 36 is assembled with a cross rail 18, the section 50 is first aligned horizontally with a pair of aligned slots in the cross rail 18 following which the foot portion is inserted horizontally through the widened central section 60 of the slot 58 to a position in which the torsion bars 46 and 48 are bearing supported in the end portions 62 of the aligned slots. The thicker end sections 62 provide improved bearing supports for the torsion bars 46 and 48 and enable prolonged service life of the springs 36 and use of the box spring assembly 10 with less risk of objectionable noise from rubbing torsion bars and cross rails. In addition, the wider central section 60 as the slot facilitates assembly of spring 36 and cross rails 18 to form the box spring assembly 10.

What is claimed is:

1. In a box spring assembly which includes a frame having cross rails and a plurality of load supporting spring members mounted on the cross rails wherein each of said rails has at least a portion of a generally inverted U-shape with a pair of spaced upright webs of predetermined thickness, the improvement comprising means providing pairs of aligned slots in said webs, each of said slots having an elongated central section of predetermined width in a vertical direction and end bearing sections of substantially C-shape and reduced width relative to said predetermined width, said bearing sections being of increased thickness relative to said predetermined thickness of said webs, said bearing sections thereby having increased contact surface area in a direction transversely of said rail, at least some of said springs having foot portions shaped to extend through said aligned slots in said rails and rotatably engage the increased contact surface area of the bearing sections at opposite ends thereof.

2. The structure according to claim 1 wherein said springs are formed of wire of a diameter corresponding substantially to said width of said bearing sections.

3. The structure according to claim 2 wherein said cross rails are formed of metal and said bearing sections are extruded from said webs so that the bearing sections in aligned slots extend toward each other.

4. The structure according to claim 1 wherein each of said foot sections is of generally U-shape having a pair of spaced legs which are spring urged in directions away from each other into bearing engagement with the bearing sections at the ends of aligned slots in said rails.

* * * * *